United States Patent [19]

Theien

[11] Patent Number: 4,581,856

[45] Date of Patent: Apr. 15, 1986

[54] APPARATUS FOR HIGH TOOTH EQUALIZATION OF CUTTERS

[75] Inventor: Clarence M. Theien, Rockford, Ill.

[73] Assignee: Superior Machinery Inc., Rockford, Ill.

[21] Appl. No.: 532,832

[22] Filed: Sep. 16, 1983

Related U.S. Application Data

[63] Continuation-in-part of Ser. No. 423,653, Sep. 27, 1982, Pat. No. 4,512,114.

[51] Int. Cl.[4] ..... B24B 3/38

[52] U.S. Cl. ..... 51/250; 144/114 A

[58] Field of Search ..... 51/246, 250, 288, 5 D, 51/281 R, 216 R, 204, 161, 211; 144/114 A, 116, 117 B, 117 R, 134 R, 369, 218, 230; 83/174, 174.1; 279/1 M

[56] References Cited

U.S. PATENT DOCUMENTS

| | | | |
|---|---|---|---|
| 985,473 | 2/1911 | Thomas | 51/246 |
| 1,114,743 | 10/1914 | Fosterling | 51/246 |
| 2,347,170 | 4/1944 | Brown et al. | 51/216 R |
| 2,864,210 | 12/1958 | Mann | 51/246 |

OTHER PUBLICATIONS

An Assembly of Installation or Operation Manuals and Specification Sheets Relating inter alia to Model C Drives and Model No. 464 Moulders Made and Sold by Ekstrom, Carlson & Co. of Rockford, Illinois, date unknown; but prior to 1960, Author unknown, twenty-six sheets.

A Published Article by Fred J. Heid based on a paper presented Apr. 20, 1950 at the Southern Pine Association Exposition, reprinted by Ekstrom, Carlson & Co., Rockford, Illinois, on a date unknown, three sheets.

Ekstrom, Carlson & Co. Bulletin No. M200 pertaining to High Speed Moulders (date unknown), twelve sheets.

Two Photographs D(1) and D(2) from Ekstrom, Carlson & Co., one such photograph having been printed on p. 10 of Item C.

A print obtained from Ekstrom, Carlson & Co. and believed to show a portion of an engineering drawing for one of the Jointing Attachments manufactured by Ekstrom, Carlson & Co. in the 1950 or 1960 decade.

A brochure entitled "EXTRAS", published by Michael Weinig GmbH & Co. of West Germany and pertaining to Moulders manufactured by that firm, date unknown, twenty sheets.

A brochure entitled "Hydromat" published by the above-identified Weinig Firm and pertaining to a family of Moulding Machines made and sold by such firm, date unknown, nine sheets.

A publication by the aforesaid Weinig Firm, comprising four pages of text and dealing with the subject of "Jointing" Moulder Knives in Weinig Machines, date unknown, four sheets.

*Primary Examiner*—Roscoe V. Parker

*Attorney, Agent, or Firm*—Leydig, Voit & Mayer, Ltd.

[57] ABSTRACT

Methods and apparatus for equalizing the effective radii of multiple cutting elements on a power-driven spindle of a machine tool. A fixture carrying an abrasive stone is placed upon a pre-existing workpiece supporting or guiding surface in the machine tool, slidably shifted on that surface to bring the stone to juxtaposed alinement with the cutter edges, and then magnetically locked to that surface. Positionable elements in the fixture are then used to infeed the stone so that the cutters are ground off to effectively equal radii. The methods and apparatus are equally applicable to straight or profiled cutters, and one portable fixture may be employed to condition the cutters of several spindles in a given machine as well as spindles of different machines.

14 Claims, 19 Drawing Figures

APPARATUS FOR HIGH TOOTH EQUALIZATION OF CUTTERS

This application is a continuation-in-part of applicant's co-pending application Ser. No. 423,653, filed Sept. 27, 1982 and subsequently issued as U.S. Pat. No. 4,512,114.

The present invention relates in general to machine tools of the type having a plurality of cutter teeth (also variously called knives or blades) circumferentially spaced around one or more rotationally driven spindles for removing material from a workpiece by what might be called shaping, sawing, planing, milling, routing or moulding action. More particularly, the invention relates to method and apparatus for conditioning the cutting elements in such machine tools so as to enhance or maintain the surface finish of workpieces and rate of machining action (productivity). The invention finds useful application with respect to machine tools and cutters designed to act on either wood or metal workpieces or those of other materials such as plastic.

BACKGROUND ENVIRONMENT OF THE INVENTION

For purposes of discussion, a wood-working moulding machine may be taken as an example. Such machines are per se well known as comprising in one form an elongated base having work supporting and guiding surfaces along which an elongated board or wooden strip is moved lengthwise by appropriate adjustable rate feed drive means. Spaced along the work feed path are one or more power-driven spindles, each of which in many or most cases carries a plurality of cutting elements or knives spaced circumferentially around a head attached to the spindle. The cutters may be integrally formed on the head or more frequently take the form of replaceable inserts or blades. Typically, there are four spindles—two lying on horizontal axes so that their cutters shape and/or smooth off the upper and lower surfaces of the passing wood workpiece, and two lying on vertical axes such that their cutters similarly act on the left and right edge surfaces of the workpiece.

It has been known for years that the plural cutters on a given spindle in such a machine all participate to some degree in the removal of material from the workpiece, but that the final surface finish may appear as if only the "high" or largest radius one of the cutters took the last bite. The final surface finish on an elongated moulded wood strip exhibits "knife marks" which lie transverse to the direction of feed; and an index of the quality of the surface finish is designated as higher if a greater number of shallow knife marks exists per inch of workpiece length. The knife marks per inch (and thus surface quality) on a finished piece are (a) proportional to the number of cutters spaced around the spindle head and the rotational speed (r.p.m.) of the spindle, and (b) inversely proportional to the feed rate (usually expressed in feet per minute) of the workpiece—providing that all cutters have their edges lying on equal radii, or more precisely that all cutting edges move around the same imaginary surface of revolution concentric with the spindle axis. When that latter provision is met, then all cutters participate in creating the finished surface; otherwise, one cutter is the highest and the knife marks per inch turn out to be as if only the high cutter produced the final workpiece surface.

Almost inevitably (unless in situ "jointing" is performed, as described below) one of the plural cutting edges associated with a given spindle will to some degree have a larger effective radius than the others (i.e., will move along a surface of revolution radially larger than the others). Even if cutters on a given spindle head are carefully sharpened and trued on a grinder in a tool room to have what seemingly are equal effective radii, when that spindle head is then placed in the machine tool, one cutter will almost immediately show up as the "high tooth" and create a low per inch knife mark count on finished workpieces. It is believed that this occurs because of differential thermal expansion or slight dimensional differences between a tool room grinder and the machine tool itself. Beyond that, however, even when a plural knife spindle initially produces the expected high quality surface finish, wear on the knife edges will be unequal over a relatively short time period, and one cutter edge inevitably becomes "higher" than the others so that surface finish quality degrades. In either case if a given work surface quality is to be maintained, then the feed rate must be reduced with consequent reduction in productivity and increase in production costs. Increasing spindle r.p.m. would have the same compensating effect as decreasing feed rate, but there are limits imposed on r.p.m. by safety and machine tool design factors.

In the wood moulder machine art, the "high tooth" problem has been dealt with by a procedure known as "jointing". The origin of that term is unknown; it is a confusing misnomer not to be confused with the wood working procedure known as "joining" practiced by joining machines. In any event, "jointing" as applied to moulding machines involves bringing an abrasive stone progressively inwardly toward the cutting edges of a rotating plural-cutter spindle so as to wear off, by grinding action, the higher (larger radius) cutting edges until all cutting edges move at the same effective radius, i.e., describe the same surface of revolution about the spindle axis. This is done at periodic intervals (e.g., every 4 to 8 hrs.) depending on the rapidity with which the surface finish on produced workpieces degrades. It is carried out in situ in the machine tool which contains the plural cutter spindle and it permits the finished surfaces to be kept within a chosen, acceptable range of quality (knife marks per inch) without reducing feed rates and thus workpiece production rates.

PRIOR ART STATEMENT UNDER 37 C.F.R. 1.97

To the extent of applicant's knowledge and in his opinion, the prior art most relevant to the invention hereinafter described and claimed is reflected by the following items:

A. An assembly of installation or operation manuals and specification sheets relating inter alia to Model C drives and Model No. 464 Moulders made and sold by Ekstrom, Carlson & Co. of Rockford, Ill. Date unknown; but prior to 1960.

B. A published article by Fred J. Heid based on a paper presented Apr. 20, 1950 at the Southern Pine Association Exposition.

C. Ekstrom, Carlson & Co. Bulletin No. M200 pertaining to High Speed Moulders (date unknown).

D. Two photographs D(1) and D(2) from Ekstrom, Carlson & Co., one such photograph having been printed on page 10 of Item C.

E. A print obtained from Ekstrom, Carlson & Co. and believed to show a portion of an engineering drawing for one of the jointing attachments manufactured by Ekstrom, Carlson & Co. in the 1950 or 1960 decade.

F. A brochure entitled "EXTRAS", published by Michael Weinig GmbH & Co. of West Germany and pertaining to moulders manufactured by that firm.

G. A brochure entitled "Hydromat" published by the aboveidentified Weinig firm and pertaining to a family of moulding machines made and sold by such firm.

H. A publication by the aforesaid Weinig firm, comprising four pages of text and dealing with the subject of "jointing" moulder knives in Weinig machines.

From Items A and B it may be seen that the need for, and the practice of, jointing plural cutters on a spindle has been recognized for years. The workpiece surface quality to be expected, if all cutting edges have effectively equal radii, is expressed in knife marks per inch as a direct function of the number of cutters spaced around the spindle axis, the spindle r.p.m., and an inverse function of the work feed rate.

It was further know to "joint" straight cutters by employing a relatively narrow stone clamped mechanically in jaws and arranged to be fed inwardly toward cutting edges of the knives while they were rotating with the spindle in a machine,—the stone then being fed lengthwise of the cutter edges (parallel to the spindle axis) to bring all edges to the same radius. See FIG. 7 in Item A and see Item D(1). Such longitudinal edge feed of a stone assumes that the latter does not itself wear down during one grinding pass. In such longitudinal pass arrangements, manually actuated lead screws acting on two slides moving in respectively orthogonal directions were provided to permit the infeed and longitudinal feeding.

The Ekstrom, Carlson "jointing attachment" was described as removable and boltable to a machine at different positions so that it could be used to true up the cutters on different spindles within a given machine tool. See the page which immediately follows FIGS. 7–10 in Item A. Applicant is aware that the Ekstrom, Carlson "jointing attachment" could be and was removable and replaceable on a single machine (or on different machines of the same model) for jointing the cutters of upper, lower, left side and right side spindles. This required, however, that the machine be especially designed to provide what might be termed "mounting pads" (and the space therefor) to receive the "attachment" and bolts for rigidly holding it in place. The attachment weighed on the order of forty pounds and was awkward and time consuming to use. Due to the weight and the size, it was difficult to adjust the attachment to get the stone accurately alined with cutting edges of a given spindle before the cutter truing operation was performed. Such alinement was essential because the stone used was extremely hard (to prevent its wearing away) and formed stones to act on profiled (rather than straight) cutters not only were expensive but had a limited life. Applicant recalls and estimates that about sixty to one hundred twenty minutes were typically required to "joint" the cutters on four spindles in the Model 464 machine that was adapted to cooperate with the Ekstrom, Carlson "attachment". Such "down time" for jointing interrupted production and was thus expensive.

The details of the Ekstrom, Carlson attachment are more readily discernible from Items D(1), D(2) and E. Item D(1) shows longitudinal feeding for jointing straight knives after infeed positioning had been completed; Item D(2) shows infeed for jointing profiled knives with a formed stone of mating profile.

The Weinig firm of Germany is a leading manufacturer of moulding machines. Those machines fall broadly into two categories, namely, (a) relatively inexpensive machines in which in situ jointing of cutters has not been (heretofore) possible and (b) the more expensive, faster machines which are manufactured with a separate, built-in jointer mechanism adjacent each of the several spindle heads. See in Item F the photograph captioned "Built-in Jointer"; and see in Item G the six photographs which deal with "jointers". In the latter machines, space must be especially provided to receive the built-in jointer mechanisms; and their complexity and cost also add to the expense of the machine. For a small wood shop operator on a low capital equipment budget, the ability to purchase jointing capability with an economy-priced machine—or for an old machine—has been beyond reach.

Item H describes the manipulative steps recommended by the Weinig firm for carrying out jointing on its machines. This includes the use of a relatively "soft" abrasive stone (see page 4) and "finish profiling of the jointing stone with the profile knives through slowly turning the spindle by hand" (page 1). Such procedure scrapes and erodes the stone so that the latter's profile is brought into agreement with that of the knives subsequently to be jointed when the spindle motor is turned on.

It would appear that the cutters of four or more spindles in a Weinig moulder of the expensive category may be "jointed" with relatively little down time once the stones have been mounted and shaped in all of the several separate jointing mechanisms. But this comes at a greatly increased cost for the machine and its several separate built-in jointing mechanisms which are each respectively dedicated to one spindle.

Finally, it has long been known in the art to employ "magnetic chucks" for holding workpieces in machine tools. Applicant is unfamiliar with the detailed construction and use of magnetic chucks, but those working in the machine tool art know that excitation may be turned on or off to lock or release a magnetically permeable member to or from the chuck surface.

OBJECTS AND ADVANTAGES OF THE INVENTION

It is the primary aim of the present invention to provide apparatus and methods which make it possible to equalize the effective radii of plural cutting elements (whether straight or profiled) associated with a power-driven spindle in a machine tool—by in situ action and without the machine having any special mounting pads or built-in mechanisms created for that purpose.

Indeed, it is a corollary object to make it possible to effect such in situ equalization in simple, economy-priced machine tools or old, pre-existing machine tools as to which equalization was never contemplated and could not be achieved.

As applied specifically to wood moulders (and similar machines such as routers, rip saws, joiners as well as similar types of metal working machines having multi-knife, i.e., multi-blade or multi-tooth cutting elements), it is an object to make it possible—easily, quickly and at relatively low cost in terms of apparatus price and down time—to "joint" the plural knives of one or more spindles in the machine, and despite the fact that the machine was not originally designed for and lacked the original capability for jointing of its cutters. Whether the machine is of ancient vintage or of new but low price construction, the invention brings to it the same advantages of "jointing"—and the higher production speeds or better work surface finishes which flow from jointing.

It is another object of the invention to provide apparatus and methods for in situ equalization of the effective radii of plural cutting elements associated with a power-rotated spindle—and wherein a single, low-cost, portable fixture may serve to effect such equalization with respect to several or all of the spindles in a given machine—and further, several or all of the spindles in several machines, even when the machines are of different specific types and configurations.

A further object is to bring to the art methods and apparatus for equalizing the effective radii of plural cutting elements associated with a power-rotated spindle in a relatively short lapsed period, thereby to reduce down time during which machine production is interrupted—thereby making it feasible to equalize or "joint" cutters more frequently and thus to maintain high quality, consistent surface finishes on workpieces.

And finally, it is an object to bring to the small shop operator—with his old or low-cost machine tools—all of the above-recited advantages but with only a very nominal added investment in the fixture now to be described.

BRIEF DESCRIPTION OF THE DRAWINGS

Other objects and advantages will become apparent as the following description proceeds in conjunction with the accompanying drawings, in which.

DETAILED DESCRIPTION OF EXEMPLARY EMBODIMENTS AND PROCEDURES

While the invention has been shown and will be described in some detail with reference to specific exemplary method and apparatus embodiments, there is no intention thus to limit the invention to such detail. On the contrary, it is intended here to cover all alternatives, modifications and equivalents which fall within the spirit and scope of the appended claims.

Figure 1:
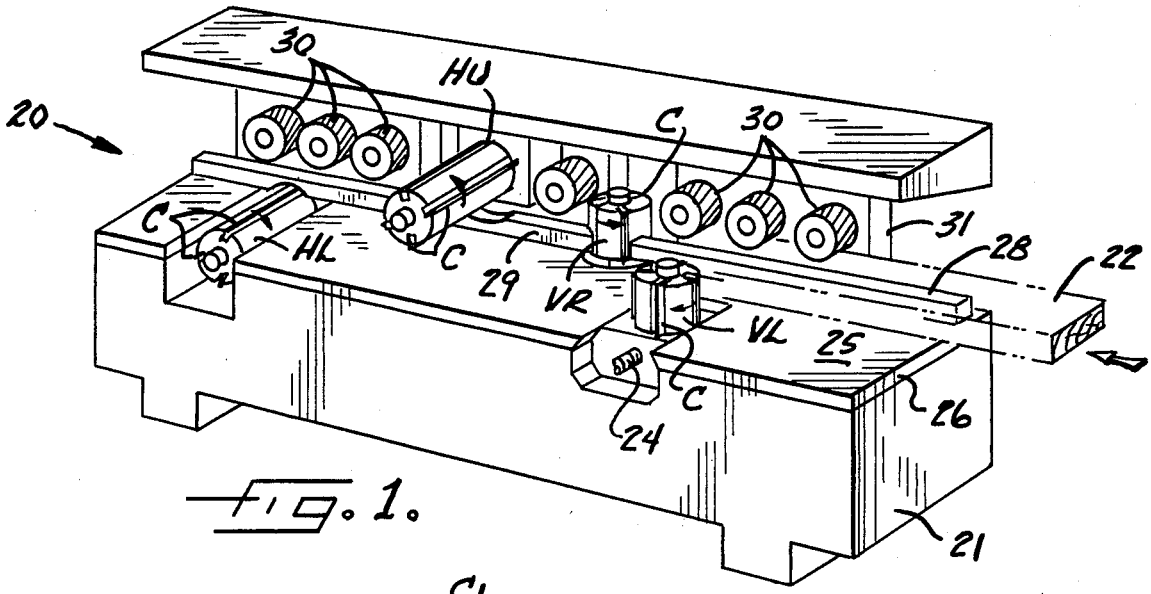
FIG. 1 is a simplified perspective view of a typical machine tool, here shown as a four spindle wood moulder, representing the background environment in which the invention will find use.

The typical machine tool 20 of FIG. 1 is a wood moulder conventionally comprising a base 21 and four spindles HU, HL, VR, VL each of which is rotationally power-driven by means such as an electric motor (not visible) which can be turned on or off and adjusted to provide different desired speeds (generally, between 3000 and 7000 r.p.m.). In the simplified illustration of FIG. 1, the spindles, in a strict sense are not visible; rather, the cutter heads removably mounted on and thus forming a rigid extension of the spindles are visible. For convenience, a head will be called a "spindle" since the two are, in effect, one unitary part.

In well known fashion, each spindle carries a plurality of equally and circumferentially spaced cutting elements C having cutting edges which extend longitudinally parallel to that spindle's axis. While the number of cutting elements on a given spindle may be chosen at will (e.g., from two to twenty, for example) four such elements C are here shown on each spindle merely as a typical choice. Although the cutting elements C may be formed integrally on a steel head, they here are shown conventionally as replaceable cutter inserts fixed firmly in sockets of the head by cap screws or the like. The cutters are made of high speed tool steel and ground to blade sharpness with appropriate relief angles according to practices well known in the art.

The spindles HU and HL are oriented along horizontal axes and disposed such that their cutters act respectively on the upper and lower surfaces of a workpiece here shown as an elongated wood board 22; the spindles VR and VL lie on vertical axes so that their cutters act on the right and left edge surfaces of the workpiece as viewed from the right end of the machine and in the direction of workpiece feed.

Each of the four spindles is adjustable in position both in a vertical and horizontal sense by positioning lead screws or the like (not shown). The vertical adjustments of spindles HU and HL determine the "bite" taken off of the upper and lower surfaces (and the final vertical thickness) of the workpiece 22; and their horizontal (axial position) adjustments permit their cutters to register properly with the workpiece in a direction transverse to the latter's feed direction. Similarly, horizontal adjustments of the spindles VR and VL determine the "bite" taken off the right and left edges (and the final horizontal width) of the workpiece 22; and their vertical adjustments permit their cutters to register properly with the workpiece edges in a vertical sense. The horizontal positioning screw 24 for the spindle VL appears fragmentarily in FIG. 1.

The invention to be described is applicable to a class of widely different specific machine tools which have in common the characteristic of at least one power driven spindle having plural, circumferentially spaced cutting elements. The class embraces machine tools wherein the workpieces are fed past the rotating spindle or the rotating spindle is fed along the workpiece, only the relative feeding the two being necessary. The nature of the workpiece—whether it be wood, metal or plastic—does not preclude the applicability of the invention. In all machine tools of the class, however, there inevitably exist surfaces which support and/or guide and located the workpiece so as to determine its position in a direction lying radially of the spindle axis. As exemplified in FIG. 1, the machine tool 20 is constructed with a steel table member 26 defining a horizontally disposed planar work support surface 25 disposed below and above the axes of spindles HU and HL. Likewise, a fore-and-aft adjustable steel "fence" member 28 defines a planar vertical surface 29 against which the right edge of the workpiece 22 is pressed for guiding and locating action as workpiece feeding takes place. Virtually without exception in all machine tools of the class here treated, the members 26 and 28 are made of a magnetically permeable material such as steel.

To create the relative feeding of the workpiece and the four spindles, a plurality of serrated or spiral-ribbed rolls 30 are journaled in a vertically adjustable frame 31 to project forwardly on horizontal axes. For any vertical thickness of the workpiece 22 the frame is set to make these rolls engage the upper surface of the workpiece (thereby pressing it lightly against the support surface 25). Synchronized rotational drive (by an adjustable speed, motor-driven mechanism, not shown) of the rolls then causes longitudinal feed of the workpiece across the table surface. The spindle cutting elements thus cut and shape or plane all four workpiece surfaces simultaneously. It will be recognized, of course, that the support surface 25 is interrupted in the region of the spindle HL so the cutters C thereon may engage the lower workpiece surface; likewise, the fence guiding surface 29 is interrupted in the region of the spindle VR so the latter's cutters may engage the right workpiece surface.

Figure 2:
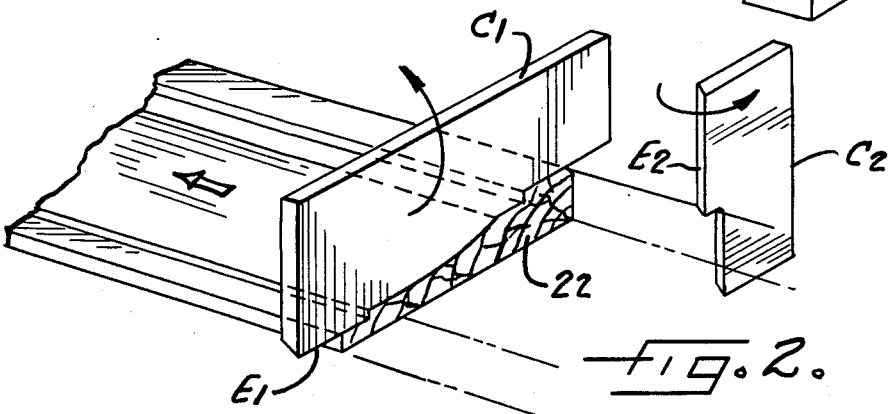
FIG. 2 is a fragmentary perspective showing the action of cutter elements, carried by the upper and right spindles, on a workpiece.

Generally speaking, any set of cutters on any spindle may have straight or profiled cutting edges, depending on the desired shape to be given to the corresponding workpiece surface. As shown in FIG. 2, the cutting element C1 has a profiled shape at its edge E1 and as it rotates counterclockwise with the spindle HU it leaves the workpiece correspondingly shaped. The element C2 on the spindle VR, on the other hand, is straight along cutting edge E2 in a direction parallel to that spindle's axis; and it leaves the right edge of the workpiece flat. The term "contour" will here be used to designate generically the longitudinal shape of cutting edges whether they may be "straight" or "profiled", as illustrated for the edges E2 and E1.

In accordance with the present invention, the edges of cutters on a spindle—such as any of the spindles of the machine tool 20 in FIG. 1, but specifically the spindle HU—may be equalized and brought to the same effective radii (so that they move in a common surface of revolution about the spindle axis) by the following procedures stated in summary form:

First, an abrasive stone 40 (FIG. 3) is locked in a carrier 41 of a fixture 42, that carrier being linearly movable and positionable along a predefined path relative to a fixture base 44. The stone 40 has an operative edge **40*a*** which in length equals or exceeds the working length of the spindle cutters C1 and which in contour generally conforms to the cutter contour.

Second, the fixture 42 is placed on a planar work support surface (here, 25) of the machine tool, near the spindle to be treated and with freedom to slide on that surface. The base of the fixture has a planar foot surface defined by one or more feet and here termed the "reference plane" of the fixture. The feet are normally freely slidable on the work support surface 25.

Third, while the spindle is not rotating, the fixture base is slidably shifted relative to the support surface 25 to locate the stone's edge **40*a* in juxtaposed general alinement with the cutting edge E1 of at least one of the elements C1. As indicated by the solid head arrows in FIG. 4, the fixture may be moved toward, away or swiveled in either horizontal direction until visual inspection confirms that the edges 40*a*, E1 are alined in a horizontal sense parallel to the spindle axis and separated by a small uniform gap 45**. Although not vital, one may choose to use a feeler gage to insure that the gap is uniform at several places along its length.

Fourth, the fixture base is then locked to the work support surface 25. In keeping with an important aspect of the invention in a specific form, this locking is accomplished without in any way modifying the work support surface 25 or detracting from its planar shape and extent; such locking is accomplished by activating magnetic means which create sufficiently strong attraction between the fixture base and the steel work table 26 as to prevent shifting of the base during the ensuing steps to be described.

Fifth, and optionally, the carrier 41 is moved inwardly while the spindle HU is rotated at a speed drastically less than its range of normal working speeds while the stone 40 is fed relative to the base 44 and inwardly toward the cutters C1—thereby to cause scraping and shaping of the stone's operative edge **40*a* by at least one of the cutters. This may be done by rotating the spindle manually while turning a fixture knob 46 fixed to a lead screw 48 (FIG. 7) journaled in the base 44 and cooperating with a nut 49 on the carriage 41. This procedure, especially if the grade chosen for the stone 40** is "soft", makes the blades themselves shape the stone edge contour and avoids the need first to precisely shape the stone by means of a template and manual or machine shaping.

Sixth, the spindle drive means or motor is turned on so that it is driven at a selected speed within its range of working speeds.

Seventh, the fixture carrier is infed toward the passing cutter edges E1 a desired amount which makes certain that the edges of all cutters are traveling in a common surface of revolution concentric about the spindle axis. Generally speaking one knows that this will be accomplished if the carrier is fed inwardly a predetermined distance; this in effect grinds away the "high teeth" until all have an effective radius equal to that one which originally was the "low tooth".

Once that procedure has been completed, the cutters of the spindle HU have been "jointed". The stone's edge may be retracted slightly by turning the knob 46 and lead screw 48; then the magnetic base locking means can be deactivated and the fixture removed from the machine. It may thereafter be employed to "joint" other spindles of the same or a different machine tool.

The fixture 42 is relatively small, light and easily portable. For removable locking of the stone 40 in the carriage 41, the latter includes a horizontal member 50 defining a slot 51 into which the rear portion of the stone 40 is inserted. Releasable jaw elements, preferably in the form of pistons 52 adapted to press against the top of the stone, releasably clamp the latter in that slot. As shown best in FIGS. 7 and 8, these pistons 52 have heads 52*a* with sealing O-rings vertically slidable in cylindrical cavities 52*b*. The latter communicate via passages 54, 55, 56 with a cylinder 58 containing a piston 59 axially shiftable by rotating a hand screw 60. All such cylinders and passages are filled with hydraulic fluid. Thus, when the screw 60 is turned inwardly or outwardly the fluid pressure is increased or decreased so that the pistons 52 apply or release locking forces on the stone. The mechanical advantage is very high; without special tools the locking forces on the stone may quickly be made sufficiently great that dislodgement is with certainty prevented.

Figure 3:
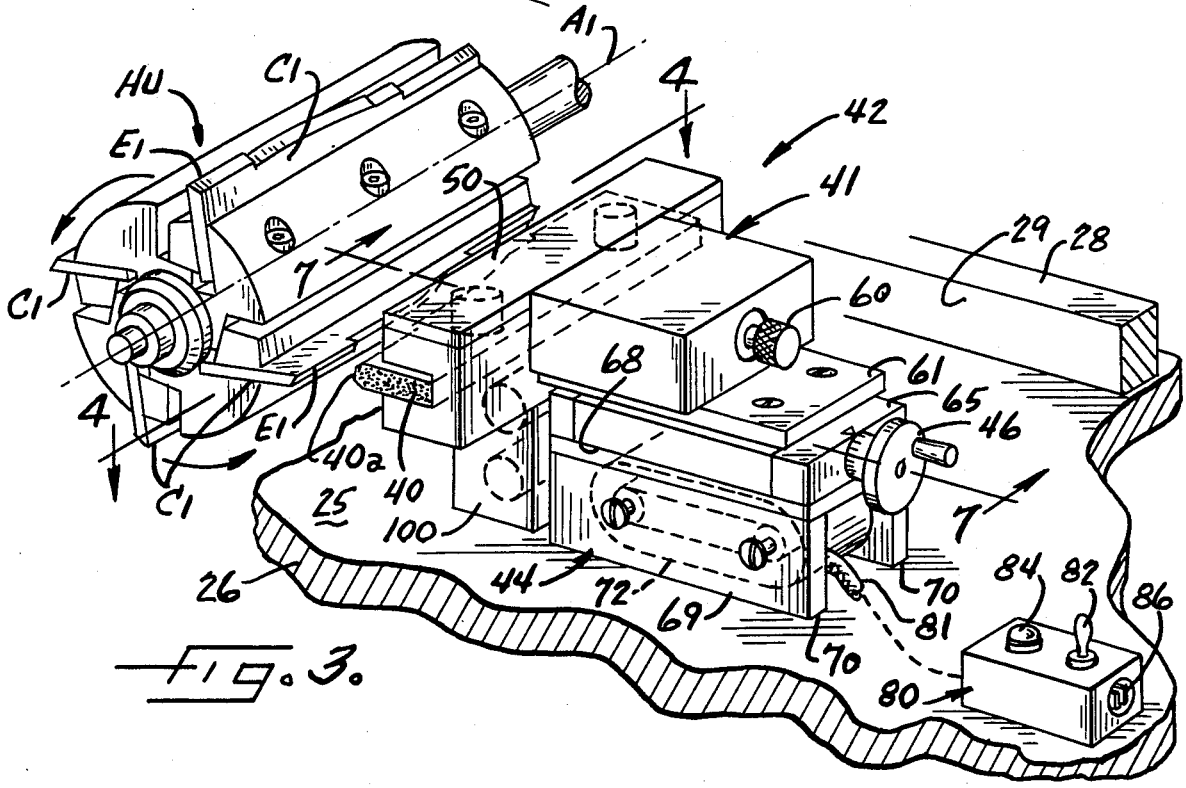
FIG. 3 is an over-all perspective view of a fixture embodying the features of the invention and in use to equalize or "joint" the cutters of an upper, horizontal spindle according to the method of the invention.

That portion of the carrier which extends rearwardly of the stone to house the piston 59 is held by screws on a plate 61 fixed to a dovetail gib block 62 slidably mating with precision, Teflon-coated way surfaces 64 formed on a member 65 firmly bolted to and forming a part of the base 44. The lead screw 48 is journaled at its opposite ends by thrust bearings in the part 65 and engaged by the nut 49 carried on the block 62. Thus, the entire carrier 41 is positionable along a predefined linear path established by the ways 64 and the screw 48 and in small, precise increments readable on a scale (FIG. 3) adjacent the knob 46. It will be apparent that when the member 50 and the slot 51 therein are lined up to be parallel with the axis of the spindle HU (FIG. 3), then the path, along which the carrier 41 and stone 40 may be positioned by the lead screw 48, extends in a direction which in FIG. 3 is (a) normal to a vertical plane passing through the spindle axis A1, and (b) parallel to the planar work support surface 25 and the reference plane defined by the foot surface of the base 44.

In accordance with one aspect of the invention the fixture base 44 includes not only means which permit it to be slidably adjusted on and along a work support surface (such as 25 in FIG. 3) but also means actuatable and deactuatable for locking and unlocking the base to that surface. As here shown, these base includes an upper cross plate 68 and two depending side plates 69 having feet 70. The bottom surface of the feet define a reference plane which coincides with the planar surface 25 when resting on the latter. The flat feet 70 readily permit the fixture base to be slidably shifted in any direction on the surface 25 to carry out the alinement step described above.

Figure 7:
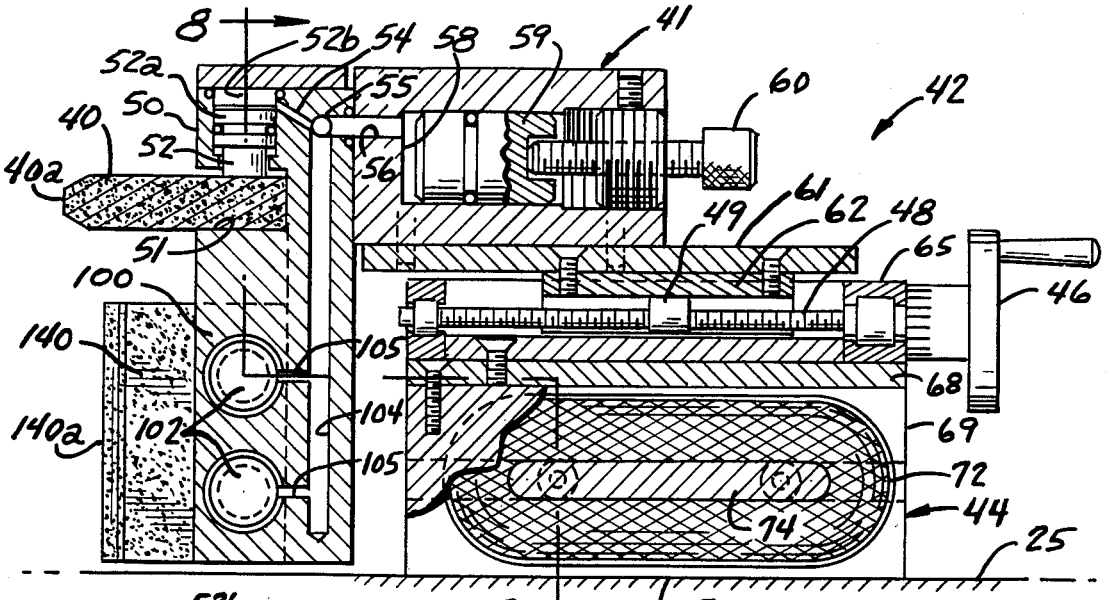
FIG. 7 is a horizontal section view taken generally along lines 7—7 of FIG. 3.
Figure 8:
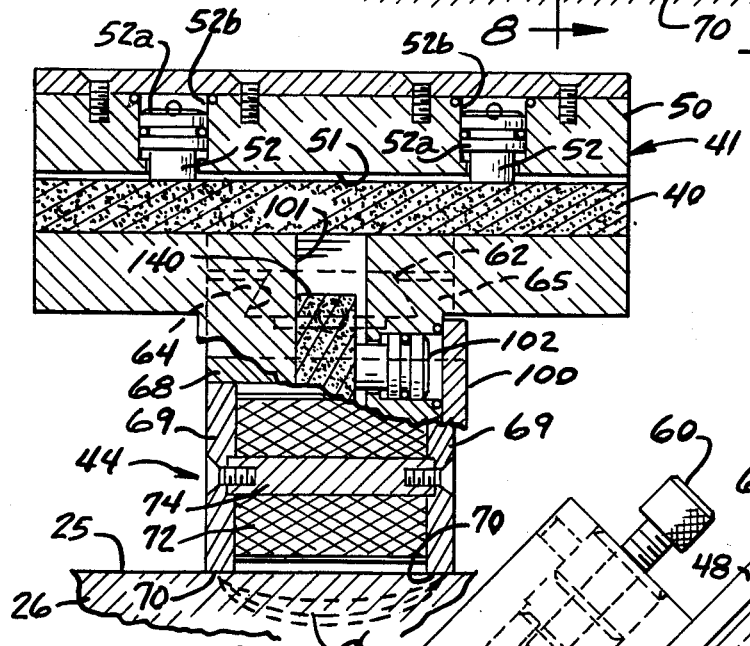
FIG. 8 is a vertical, offset section view taken generally along the line 8—8 of FIG. 7.

The base locking means take the form of a source of magnetic flux which can be controlled to create or remove flux $\phi$ passing from one side plate 69 to the other through the feet 70, the surface 25 and the table 26. Such magnetic locking means may take the form of strong permanent magnets (e.g., of the known ceramic type) disposed in the base and associated with a toggled shunt bar which is movable between two positions to selectively by-pass flux from the table 26 or to leave the table as the only low reluctance path so that flux $\phi$ passes as shown in FIG. 8. In the preferred and illustrated form, however, the magnetic locking means are electromagnetic in nature, comprising a mutli-turn coil 72 wound about a ferro-magnetic core 74 extending transversely between slots in the side plates 69 (FIGS. 7 and 8). The side plates 69 are magnetically permeable (e.g., steel) while the cross plate 68 is paramagnetic (e.g., aluminum) so that its reluctance is high. Thus, when exciting current is applied to the coil from any suitable voltage source, the coil m.m.f. forces flux $\phi$ through the table 26 and locks the base feet 70 firmly to the planar work support surface 25.

Figure 12:
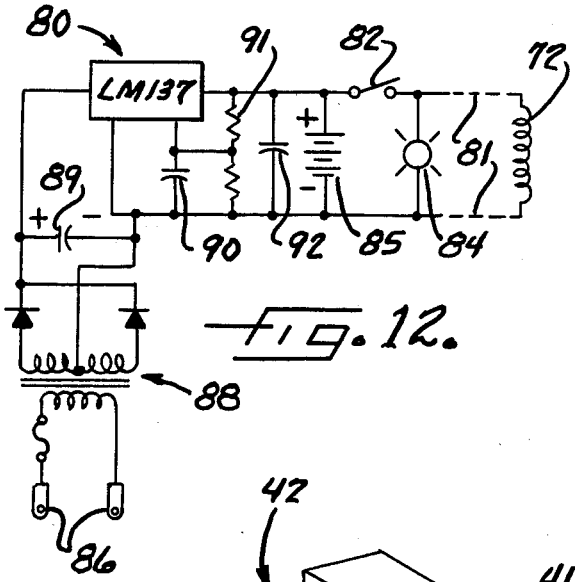
FIG. 12 is a schematic circuit diagram of the preferred voltage source and control for exciting the electromagnet in the fixture of the previous Figures.

While the voltage source and on-off switch for the electromagnet coil 72 may take many forms and provide either alternating or direct current, the preferred source supplies direct current and is easily portable with (or in) the fixture 42. As here shown, a power supply 80 is connected by a two-wire cable 81 (FIG. 3) to the coil and mounts an on-off switch 82 associated with a pilot lamp 84 which lights when the magnet is turned on. The preferred circuit within the power supply 80 is shown by FIG. 12 to include a rechargeable battery 85 (preferably nickel-cadmium) connected through the switch 82 to the pilot lamp 84 and via cable 81 to the coil 72. When the fixture is not being used, the battery 85 may be easily recharged. For this purpose the power supply 80 includes recessed connector prongs 86 to which a cord and socket, leading from a connection with 120 VAC mains, may be plugged. In this re-charging mode, a step-down transformer 88 associated with rectifier diodes creates a d.c. voltage across a filter capacitor 89. That voltage forms the input to a known regulator integrated circuit LM137 associated with a capacitor 90, voltage divider 91 and final filter capacitor 92. In known fashion, therefore, d.c. charging current is supplied to the battery 85.

Thus far attention has been devoted to the present method and the apparatus fixture 42 as applied by way of example to "jointing" of cutting elements on the horizontal upper spindle HU. Treatment of only that one spindle in the manner here described would yield significant advantage, since it is usually the HU spindle which shapes and smoothes the critical profiled upper surface of wood strips or boards. But the method and apparatus may be used in generically similar fashion on the other spindles of a machine tool, as now to be described.

I have recognized as a key to my invention the very plain and simple fact that virtually every machine tool which includes a multi-cutter spindle also has a planar work support surface defined on a magnetically permeable steel member (e.g., surface 25 on table 26)—such surface lying either parallel to or normal to the spindle axis. For years the need for equalizing or "jointing" has been known as a pressing objective to achieve high quality work surface finishes when workpieces are acted upon with feed rate sufficiently high to provide good productivity. Yet, those skilled in the art have failed to recognize that a jointing fixture of small size, light weight and low cost can be effectively employed on a machine without built in, dedicated jointers and without special attachment pads if only one uses the pre-existing work support or guide surfaces of the machine tool as locators for an attachment and provides some way for releasably locking the attachment directly to one of those planar surfaces.

A planar surface is parallel to a line constituting a spindle axis when the line, if extended, will not intersect the surface. A planar surface is normal to a line constituting a spindle axis if the line at the point of intersection with the surface plane is at right angles to all other lines lying on the surface and passing through that intersection point. One may see that the axis A1 of the spindle HU is parallel to the work support surface 25 in FIGS. 1 and 3; and the axis A2 of the spindle VR is normal to the surface 25 in FIGS. 1 and 6. But still further, it is apparent that the axis A1 of spindle HU is normal to the work support or guiding planar surface 29 (on fence member 28) in FIGS. 1 and 3; and the axis A2 of the spindle VR is parallel to the planar surface 29 in FIGS. 1 and 6.

The term "support surface" is here used as generically designating both a surface which may literally support the weight of a workpiece and a surface which is engaged by the workpiece to locate or guide the latter. Thus, the term "support surface" is here used as designating either the surface 25 or 29 shown in the drawings. It should also be noted that in many machine tools the surface 29 may extend vertically to a considerably greater height than that shown in the exemplary machine 20 of FIG. 1.

CASE I-SPINDLE AXIS PARALLEL TO A PLANAR SUPPORT SURFACE

The fixture 42 with the single stone 40 as thus far considered may be used according to the method described to dress off and equalize the cutters of the spindle HU—the axis A1 and the surface 25 being parallel (FIG. 3) and falling in what is here called Case I. But additionally if the machine tool 20 were one in which the vertical planar surface 29 were more extensive and of greater vertical height, then the fixture 42 could be placed generally to the left or right of the spindle VL with its feet 70 against the surface 29 (with the screw 48 oriented horizontally) and then slidably adjusted until the store edge 40*a* is alined with a cutter edge. After the fixture is locked to the surface 29 by excitation of the coil 72, the stone may be fed inwardly toward the cutters rotating with the head VL to true off the high teeth and equalize all cutters. The magnetic locking means are equally effective to hold the fixture to a vertical work support surface as to a horizontal work support surface.

Thus, a single fixture mounting a single stone can be used to act on the cutters of spindles whose axes are parallel to a planar work support surface of sufficient extent or area. Such a support surface will almost always exist in the machine tool for the case of a horizontal spindle HU; but it also may exist in many machine tools (although not in the illustrated machine 20) for the case of a vertical spindle such as VL.

CASE II-SPINDLE AXIS NORMAL TO A PLANAR SUPPORT SURFACE

By contrast, the present invention also is applicable when an available and sufficiently extended planar work support surface near a given spindle is normal to the latter's axis. In FIG. 1, the vertical support surface 29 is insufficient in height to have the fixture 42 first slidably shifted on and then locked to it. But the surface 25 is of adequate extent for that purpose and this enables the fixture 42 to be employed with respect to the vertical axis spindles VR and VL—as next to be described.

In keeping with one feature of the invention, the fixture 42 is constructed with a carrier that removably mounts a stone 140 having its edge 140*a* disposed in lengthwise orientation perpendicular to the reference plane defined by the foot surface of the fixture base—in contrast to the stone 40 and regardless of whether the fixture includes mounting means for holding a stone in the orientation shown for the stone 40 (i.e., with its edge 40*a* longitudinally parallel to the reference plane).

Figure 5:
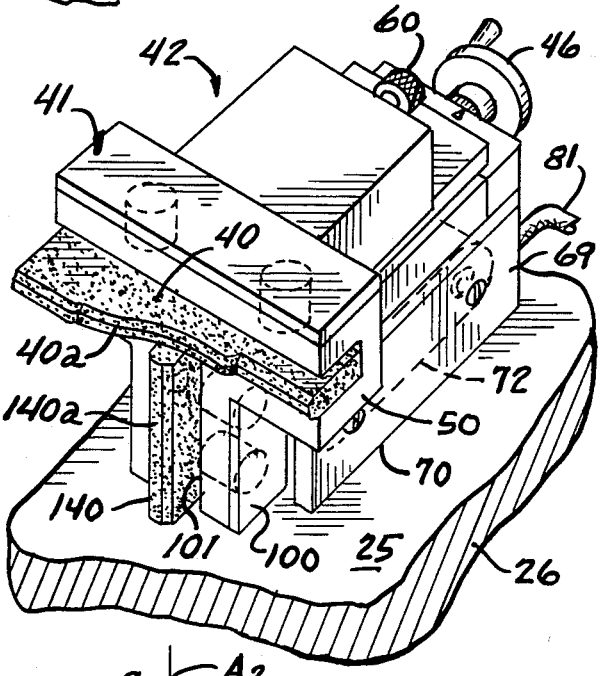
FIG. 5 is a second perspective view, taken from the front, of the fixture shown in FIG. 3.
Figure 6:
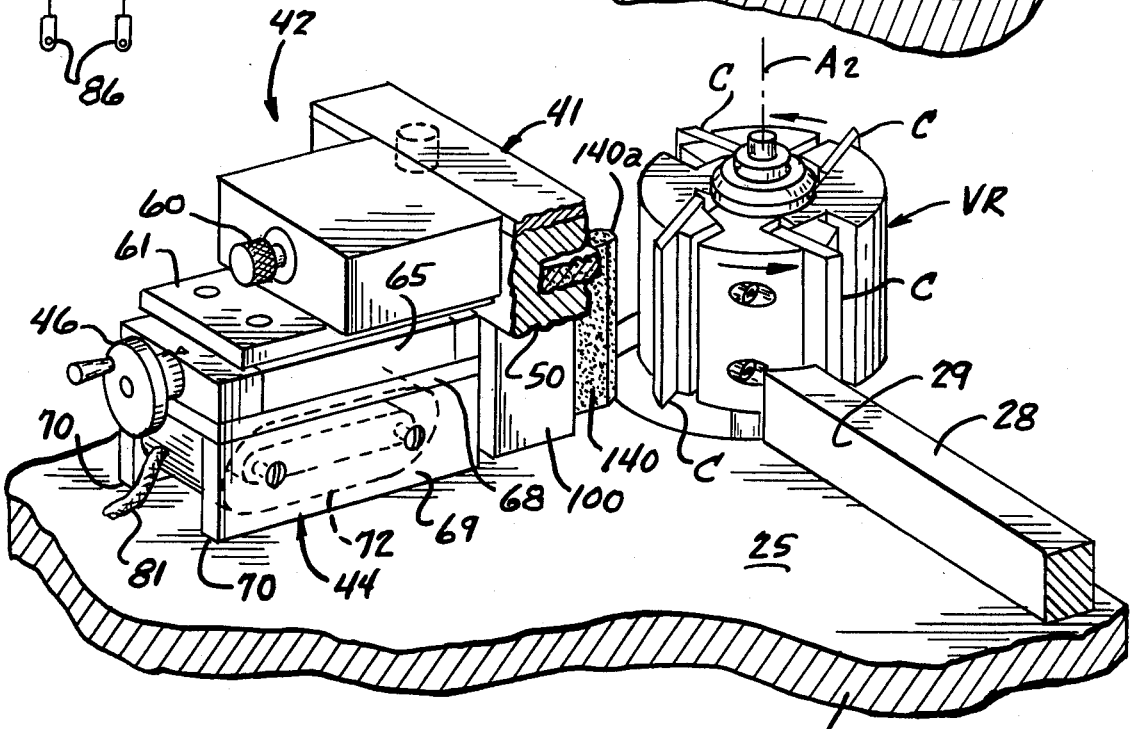
FIG. 6 is similar to FIG. 3 but taken from the right side of the fixture and showing its use with respect to cutting elements of the vertical, right spindle in the machine tool.

As shown best in FIGS. 5–7, the carrier 41 is fabricated with a vertical bar-shaped portion 100 (beneath the horizontal member 50) defining a slot 101 adapted to receive the rear edge of the second stone 140. Pistons 102 are slidable in cylinders within the portion 100, the cylinders communicating via hydraulic fluid passages 104, 105, 56 with the cylinder 58. Thus, the piston 102 (acting analogously to pistons 52 previously treated) serve as releasable locking jaws to rigidly clamp the stone 140 in the carrier with its leading, operative edge 140*a* disposed lengthwise in a direction perpendicular to the reference plane defined by the bottom surfaces of the base feet 70. The single screw 60 and piston 59 thus serve to actuate or release the locking jaws 102 and 52 for both of the stones 140 and 40—although it is of course contemplated that the fixture in some forms need not include the member 50 and the pistons 52 to hold the stone 40.

In practicing the present method with respect to the spindle VR (FIG. 6), the fixture 42 is first placed with the base feet 70 slidably engaging the work support surface 25. The reference plane of the fixture thus coincides with the planar surface 25 and the spindle axis A2 is normal to both. Conveniently and quickly, the base may be slidably shifted on the surface 25 to aline the operative stone edge 140*a* in juxtaposed relation to the vertically oriented edge of one of the cutters C on the spindle VR. As shown in FIG. 6, the cutter edges happen to be straight, and the contour of the stone edge 140*a* is thus likewise straight. By excitation of the coil 72 to create magnetic flux $\phi$ (shown in FIG. 8), the base is then locked to the surface 25. The drive motor for the spindle is next turned on. And the stone is then fed inwardly toward the cutter edges by turning the knob 46 until all cutter edges have been ground off by the stone 140 to make them move through the same cylindrical surface of revolution concentric about the spindle axis A2. Thereafter, the magnet coil may be turned off and the fixture removed from the machine.

FIG. 6 thus illustrates how the cutters of a spindle may be treated according to the present invention in those cases where an available planar work support surface on a machine tool is normal to the cutter axis. In FIG. 6, the spindle VR is mostly behind the interrupted planar fence surface 29 but the turning circle of the cutters extend forwardly of that surface to a small extent. Thus, there is plenty of room on the surface 25 (see FIG. 1) to locate the fixture and move the stone edge 140*a* into engagement with the cutter edges.

From the foregoing, it will be readily apparent that the fixture 42 and the stone 140 may be used in like fashion to treat the cutting elements on the spindle VL. The axis of the latter is normal to the support surface 25, and the edge 140*a* of the stone 140 is disposed lengthwise in a direction which lies normal to the reference plane of the base 44.

For the exemplary specific machine 20 of FIG. 1, a slightly modified fixture (described below as a special application of Case I) is used to treat the cutting elements of the spindle HL because the latter lies mostly below the interrupted planar table surface 25 (in similarity in the spindle VR which lies mostly behind the fence surface 29). It may be observed briefly, however, that if the planar work surface 29 extended to a somewhat greater height in FIG. 1, then the fixture 42 with the stone 140 (whether or not the stone 40 and its jaws are included) may be used according to Case II to deal with the cutters of the spindle HL. It would only be necessary to place the base feet 70 in engagement with the extended work surface 29, the clamped stone 140 having its edge pointing downward and its lengthwise direction disposed parallel to the axis of the spindle HL. Then, the fixture base would be slidably shifted on the surface 29 to aline the stone edge 140*a* in a juxtaposed relation to a cutter edge, after which the electromagnet would be turned on to lock the fixture to the fence surface 29. Thereafter, infeed of the carrier 41 (downwardly toward the spindle cutters), by rotation of the knob 46 with the spindle motor energized, would move the stone edge 140*a* into the cutter edges to true them to equal radii.

Figure 9:
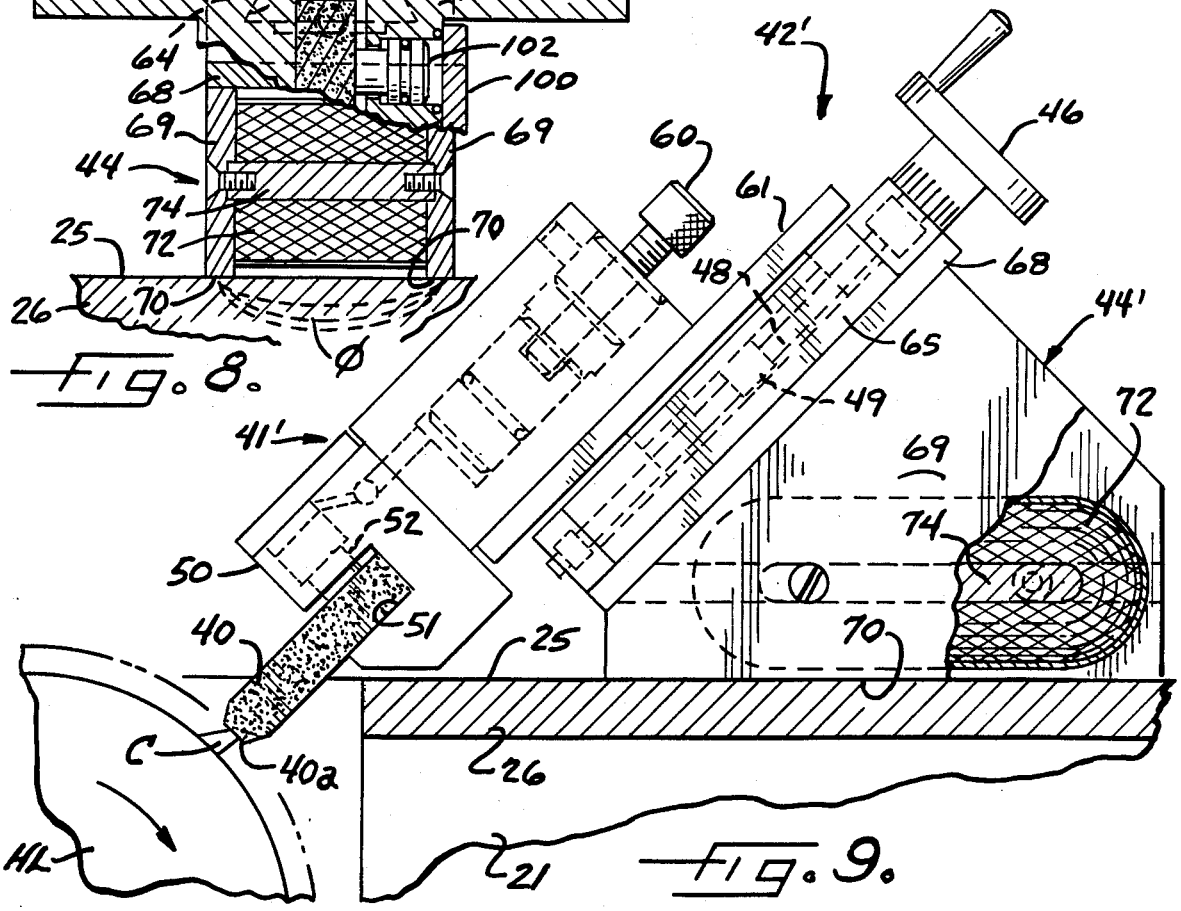
FIG. 9 is a side elevation of a modified embodiment of the fixture, and shown acting on th cutting elements of a horizontal lower spindle.

Another situation may exist which is a special application of Case I. As noted previously, the turning circle of the cutter edges on the spindle HL (FIG. 1) only slightly project above the interrupted work support surface 25. Although the axis of that spindle is parallel to the planar surface 25, the fixture 42 is previously described (and whether constructed to carry the stone 40, the stone 140, or both) cannot be readily employed to reach and act on those cutters in the absence (as shown) of the work surface 29 extending somewhat more above the table 26. To overcome this minor limitation, a fixture of the general sort here described may be constructed with a stone carrier overhanging the base 44 and movable along a vertical path perpendicular to the reference plane and thus to the table surface 25. The gap in the table surface 25 is sufficiently wide, however, that the modified fixture 42' illustrated in FIG. 9 is preferred for this special exception. Briefly stated, the fixture 42' is in all respects identical to the fixture 42 except that (a) the jaws for the vertically oriented stone 140 are omitted and (b) the base 44' is shaped to dispose the predefined path, along which the carrier 41' may be positioned, at an angle (preferably about 45°) relative to the reference plane. For FIG. 9, those skilled in the art will perceive that such an arrangement permits the stone's edge 40*a* first to be alined in juxtaposed relation to the cutter edges on the spindle HL by shifting of the base 44' on the surface 25, after which the electromagnet is turned on. The knob 46 and the lead screw 48 then permit the stone's edge—projecting downwardly below the surface 25—to be moved into truing engagement with the rotating cutters of the spindle HL.

As stated above, the spindles and cutter heads on the exemplary machine 20 (FIG. 1) are all adjustable through a fairly wide range of positions in directions transverse to their respective axes. That is, the spindles HU and HL can be adjustably positioned vertically, and the spindles VR and VL can be adjustably positioned fore and aft of the machine. This permits the spindle HU in FIG. 3 for example, to be raised or lowered to an appropriate height opposite the stone edge 40*a* and obviates any problem from the fact that the stone 40 cannot be bodily raised or lowered from its vertical position once the fixture 42 is located on the support surface 25. It is preferred, but not essential, that infeeding of the stone's edge be in a direction which lies radially of the spindle axis A1; such relationship may be obtained in FIG. 3 by changing the vertical position of the spindle.

Figure 11:
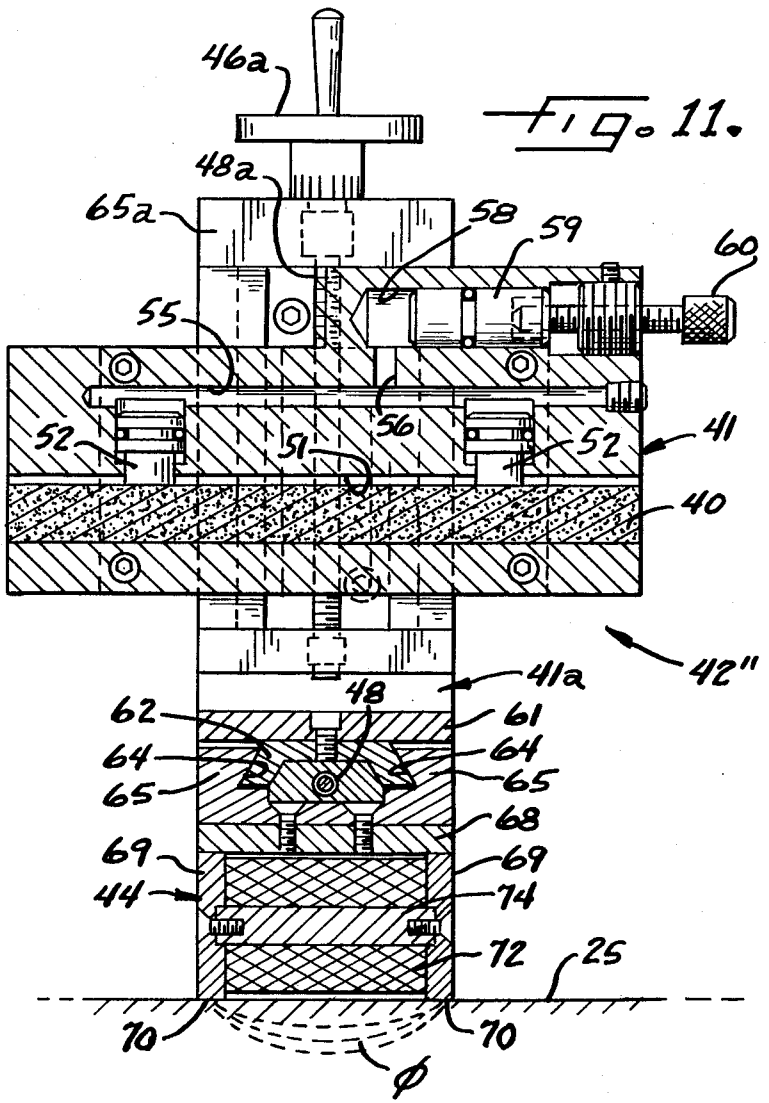
FIG. 11 is a horizontal section taken generally along the offset line 11—11 of FIG. 10.

In some machine tools having a multiple cutter spindle, however, the spindle is not bodily adjustable in a direction normal to a nearby planar work support surface. To overcome that limitation, a further embodiment of the present apparatus may be constructed as illustrated by a single stone fixture 42'' shown in FIGS. 10 and 11. Here the base 44 with its electromagnetic coil 72, ways 64, lead screw 48 and knob 46 and member 65 are all constructed as previously described—so that the member 65 forms part of a sub-carrier 41*a* which includes a vertical arm 110. The sub-carrier is thus movable to different positions along a predefined path which lies parallel to the reference plane of the base 44 (that plane being shown here as horizontal). The sub-carrier 44*a* in turn is constructed with vertically disposed ways and a lead screw 48*a* engaged with a nut 49*a* rigid with the carrier 41. The latter is in all essential respects identical to the carrier 41 shown in FIGS. 3–8 except merely as a matter of choice it does not include provisions for mounting a second stone 140. Thus, the carrier 41 has releasable jaws in the form of hydraulic pistons 52 for locking the stone 40—and it is movable both transverse to the reference plane (i.e., vertically when the knob 46*a* is turned) and parallel to the reference plane (i.e., horizontally when knob 46 is turned). When disposed on a planar work surface 25 (as illustrated for the fixture 42 in FIG. 3), the fixture 42'' of FIGS. 10 and 11 may first be adjusted by turning the knob 46*a* to bring the stone to a proper height opposite a non-adjustable spindle HU,—and then the fixture 42'' is used in the same way already described for the fixture 42, with the knob 46 being turned to infeed the stone.

Figure 10:
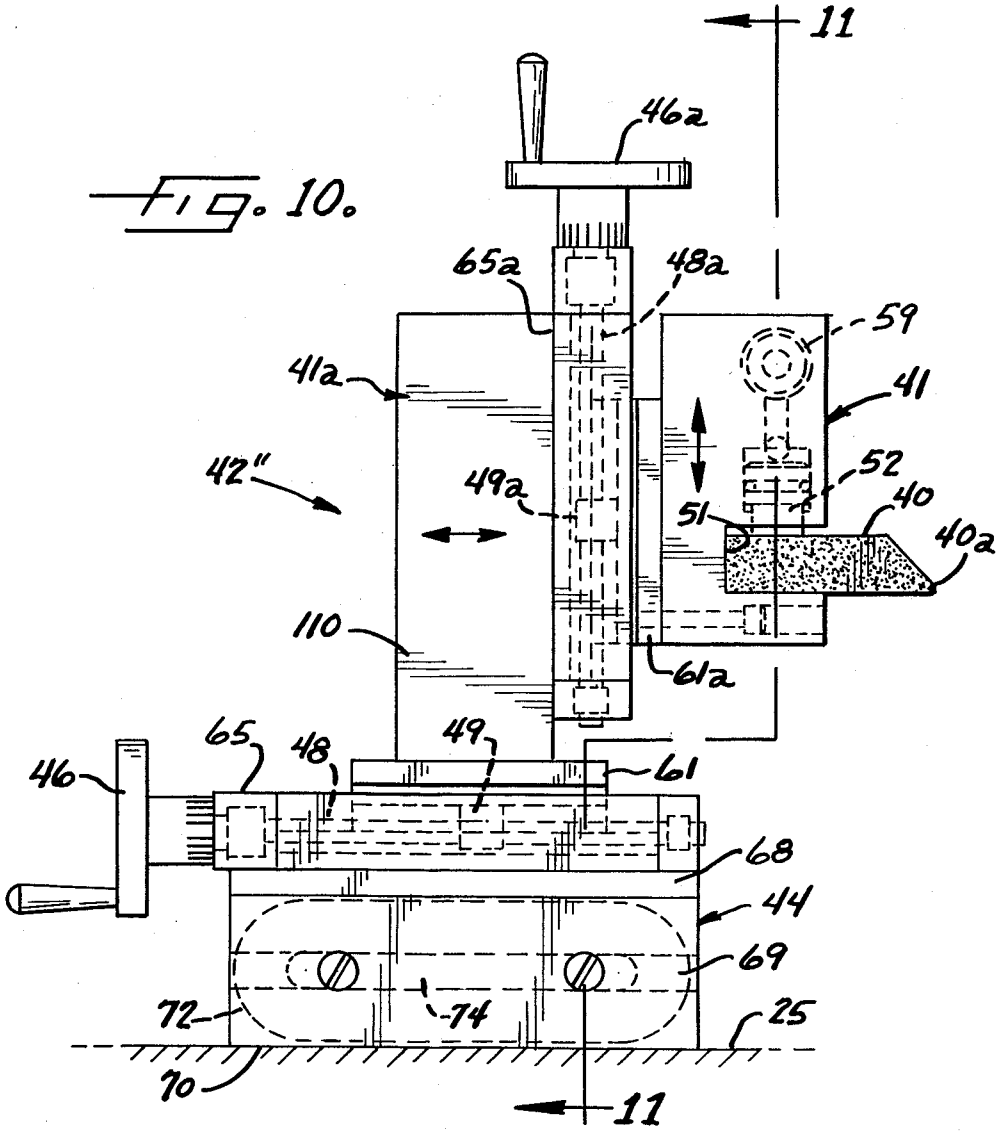
FIG. 10 is a vertical elevation view of still another embodiment of the fixture, this one being preferred for those cases wherein horizontal spindles are not readily adjustable in a vertical direction within a machine tool.

It will be understood also that, after the knob 46*a* has been turned to suitably adjust the "height" of the stone edge 40*a* above the reference plane, the fixture 42'' of FIGS. 9 and 10 may be oriented with the feet 70 against an extended vertical fence surface (such as 29 in FIG. 1). Then, after bringing the stone's edge 40*a* into juxtaposed alinement with a cutter on a vertical spindle such as that designated VL in FIG. 1, the knob 46 may be used to in-feed the stone's edge and thus to joint the cutters.

In the ideal practice of the present method, the relative location of the fixture and spindle body are first made such that the stone's edge lies generally in a plane passing through the spindle axis. In Case I, this makes the predefined path along which infeeding of the stone occurs lie in the horizontal plane which passes through the axis A1, as illustrated in FIG. 3. Although such exact relative location of the stone and the spindle body is not an absolute requisite, the fixture 42' of FIGS. 10 and 11 permits this to be accomplished in those situations where the spindle is not bodily adjustable for convenient access.

FIGS. 13–19 illustrate still another, and preferred, embodiment of the jointing fixture. This embodiment is essentially "universal" in that it is flexible or adaptable to provide the features of both the two-stone embodiment of FIGS. 3, 5, 6, and the inclined feed path embodiment of FIG. 9—while requiring but one set of jaws to mount an abrasive stone. In FIGS. 13–19, the same reference characters employed in the previous figures are used to identify like parts, except that a distinguishing suffix c is added to avoid confusion and to signify that the corresponding parts may differ slightly in details.

The case 44c in the universal embodiment includes the coil 72c wound on the core 74c extending between the plates 69c having planar foot surfaces 70c defining the reference plane—all as previously described. The base 44c further includes paramagnetic (e.g., aluminum) components here shown as an upper plate 68c integral with a front apron 68'c and a rear cover 113 to close in the base. For a purpose to be explained, paramagnetic posts 111 are fixed to the front of the base by appropriate screws or the like, the upstanding ends of such posts receiving a pivot pin which defines a tilt axis 112.

The carriage 41c has a single slot 51c for receiving the rear portion of a stone 40c which is releasably locked in place by jaw elements here shown as three pistons 52c whose inner ends receive hydraulic pressure when a piston 59c is advanced by inward turning of the hand screw 60c. The carriage 41c is, however, constructed in a manner such that the stone 40c may be selectively indexed to make its operative edge 40ac lie either longitudinally parallel to the reference plane (defined by the foot surfaces 70c) or longitudinally normal to that reference plane.

For the latter purpose, the cylinder 58c (formed in a hollow block 118 and which contains the pressurizing piston 59c) is fitted with an axially yieldable rod 114 projecting with a sealed fit to the right (as viewed in FIG. 15) where it is fixed to an indexable head 115. The head 115 defines the slot 51c and carries the locking pistons 52c. Compression springs 116, 117 keep the rod 114 generally in the axial position shown, the spring 116 being stronger and normally causing the head 115 to abut the hollow block 118. A removable locking screw 119 (FIGS. 14 and 17) rigidly pulls the head 115 up tight against the block 118, this screw being accessible through the slot 51c after the stone 40c has been removed.

The rod 114 is formed with a central passage and right-end radial passages which provide communication for hydraulic fluid flow from and to the head passages 55c, 56c leading to the jaw pistons 52c. As explained earlier, rotation of the thumb screw 60c creates or relieves hydraulic pressure which causes the pistons 52c to lock or release a stone in the carriage 41c, or more specifically, in the indexable head 115. O-rings are provided for sealing as shown.

Figure 15:
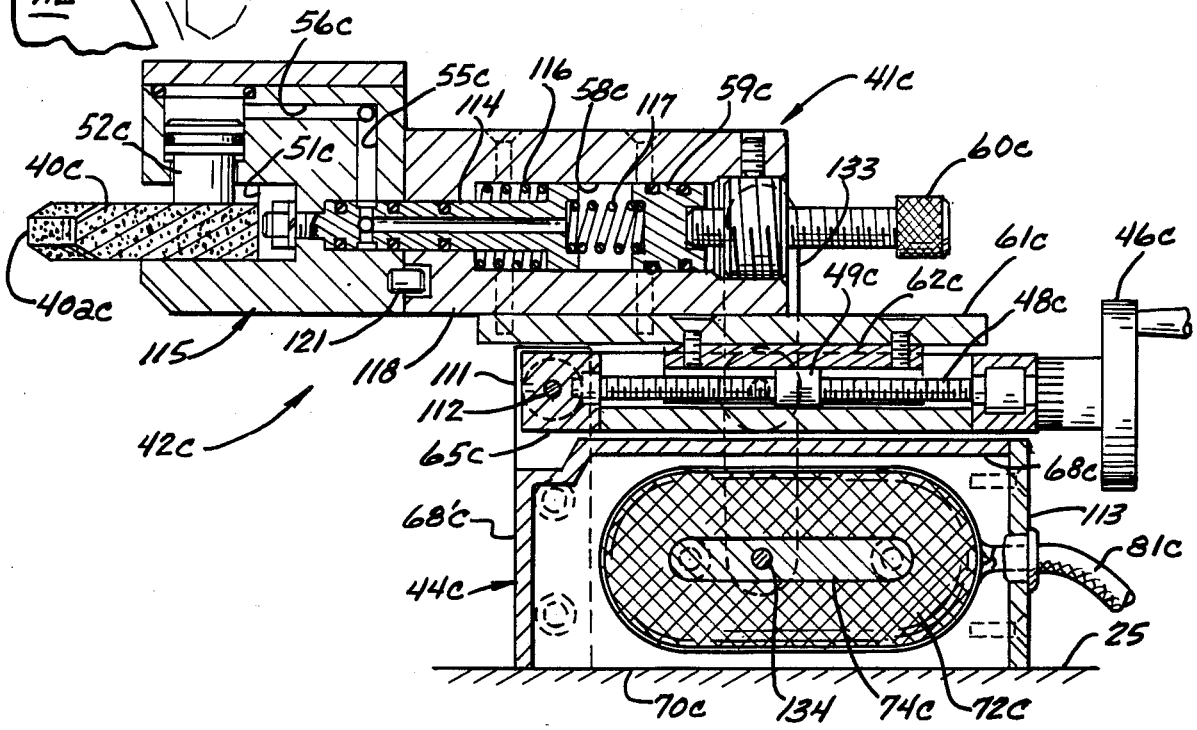
FIG. 15 is a vertical section taken generally along the offset line 15—15 in FIG. 14.
Figure 14:
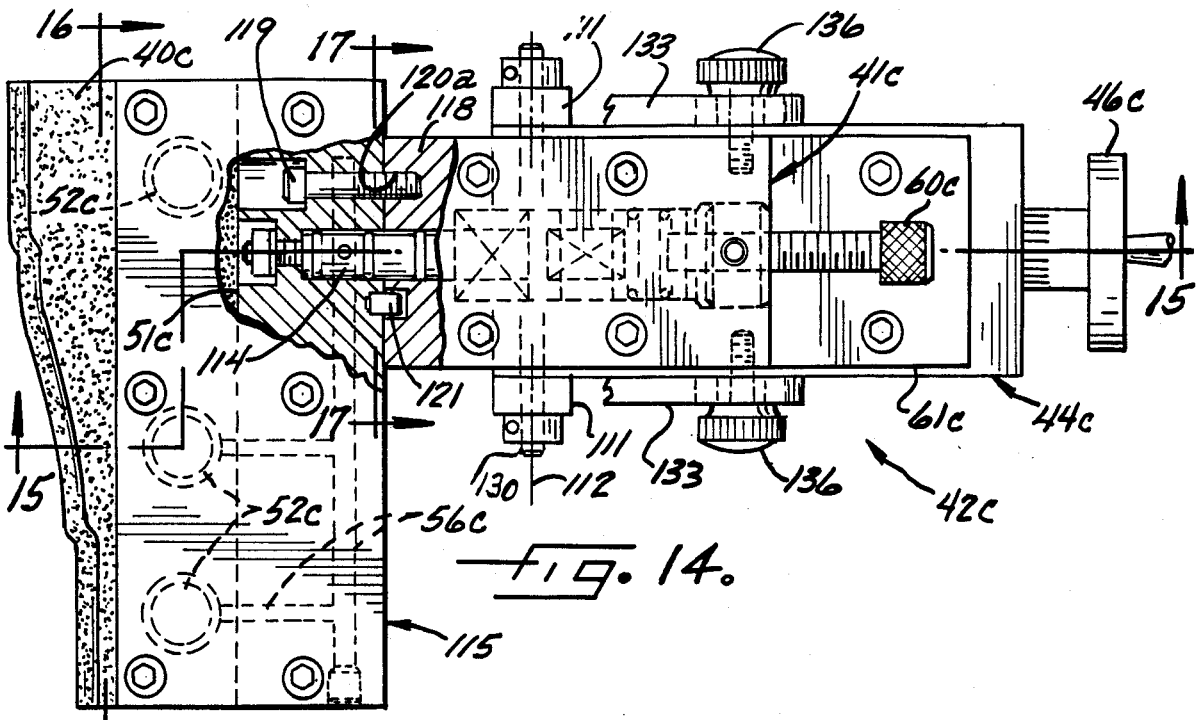
FIG. 14 is generally a plan view of the fixture shown in FIG. 13.

Let it be assumed that the fixture 42c is resting on the work support surface 25 of a machine tool, as shown in FIG. 15. The stone 40c is disposed, for all intents and purposes, like the stone 40 in the fixture 42 as illustrated in FIG. 3. Thus, the fixture 42c may be used to carry out the jointing method as described above for Case I by acting on the edges of cutters in a spindle having its axis disposed parallel to the planar work support surface. If, however, it is desired to utilize the fixture 42c to practice the method in Case II circumstances, the human operator need only first remove the stone 40c from the slot 51c to reach in with a screwdriver and remove the locking screw 119 from a tapped hole 120a in the block 118. Then, the head is pulled forwardly (against the yieldable force of compression spring 116) until two detent pins 121 (carried by a press fit on the inner face of the head 115) are withdrawn from two locator holes 122a, 122b in the block 118. The operator then rotates the head 115 ninety degrees and permits the spring 116 to pull the pins 121 into alternative locator holes 122b, 122c. The operator then inserts the locking screw into a second tapped hole 120b to rigidly fix the head in its second indexed position. A stone 140c (FIG. 18) may now be clamped by the pistons 52c in the slot 51c.

By the foregoing procedure, the head 115 has been rotationally indexed through ninety degrees about the axis of the rod 114 while the hydraulic action of the hand screw 60 and the piston 59c in actuating or releasing the locking pistons 52c has been preserved. Thus, the slot 51c and the operative edge of a stone locked therein has been changed from a first position illustrated in FIGS. 14, 15, 16, 17 to a second position illustrated in FIGS. 18 and 19. From inspection of FIG. 17, it is apparent that the tapped hole 120b lies displaced ninety degrees from the tapped hole 120a, and the locator holes 122b, 122c lie displaced ninety degrees from the holes 122a, 122b. The two indexed positions in which the head 115 may be locked thus lie displaced from one another by ninety degrees about the axis of the rod 114. This means that in the first position for the head 115, the stone's operative edge lies longitudinally parallel to the reference plane defined by the planar foot surfaces 70c; and in the second position, the stone's edge lies longitudinally normal to the reference plane.

Figure 4:
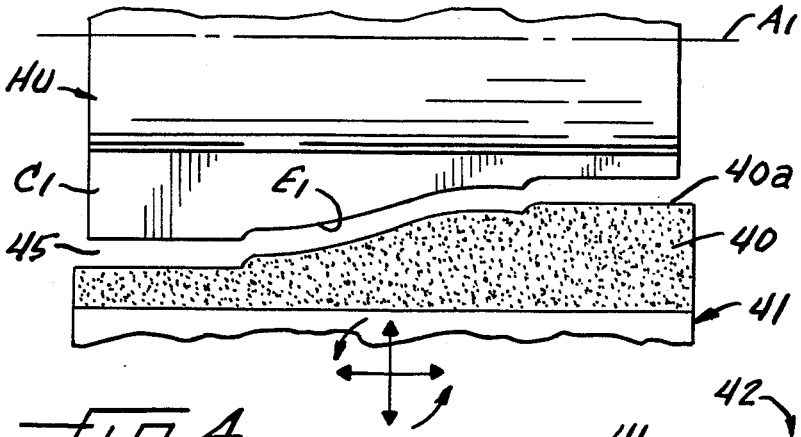
FIG. 4 is a fragmentary plan view (taken substantially along the line 4—4 of FIG. 3) of a cutting element and an abrasive stone, which in this instance are formed or profiled, during the alinement procedure to be described.
Figure 18:
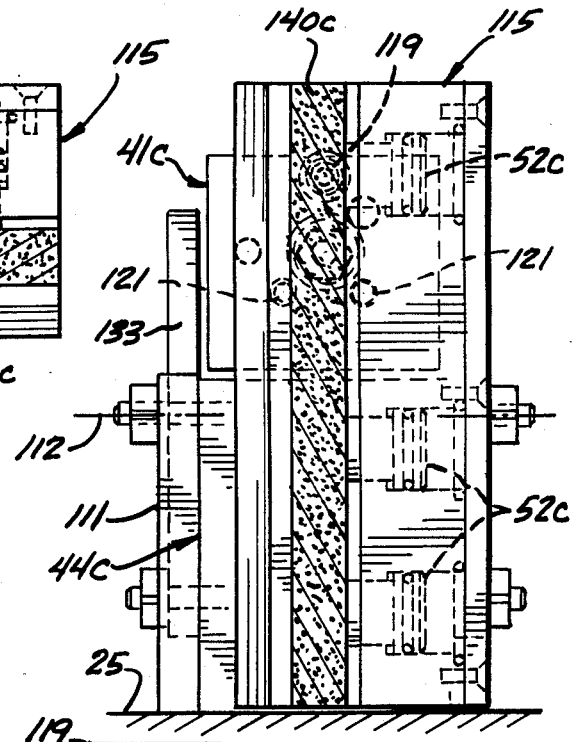
FIGS. 18 and 19 correspond respectively to FIGS. 16 and 17 but illustrate the component parts after the stone and stone carrier have been rotationally indexed through 90°.
Figure 17:
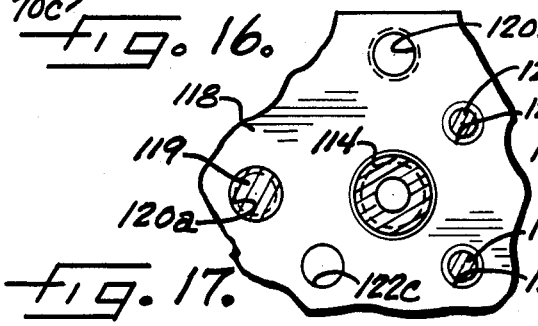
Figure 19:
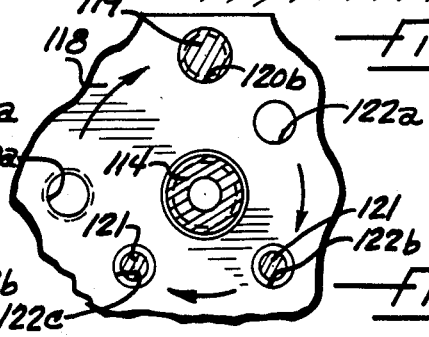

It follows that with the head in a second position, the stone 140c as shown in FIG. 18 is oriented essentially the same as the stone 140 shown mounted in the fixture 42 of FIGS. 3, 4 and 5. Thus, the fixture 42c is usable to practice the method of the invention in Case II. Only a simple indexing adjustment is required (with possibly changing of stones to accommodate different profiles of different spindle cutters) to convert the fixture to use in one case to use in the other case.

Figure 16:
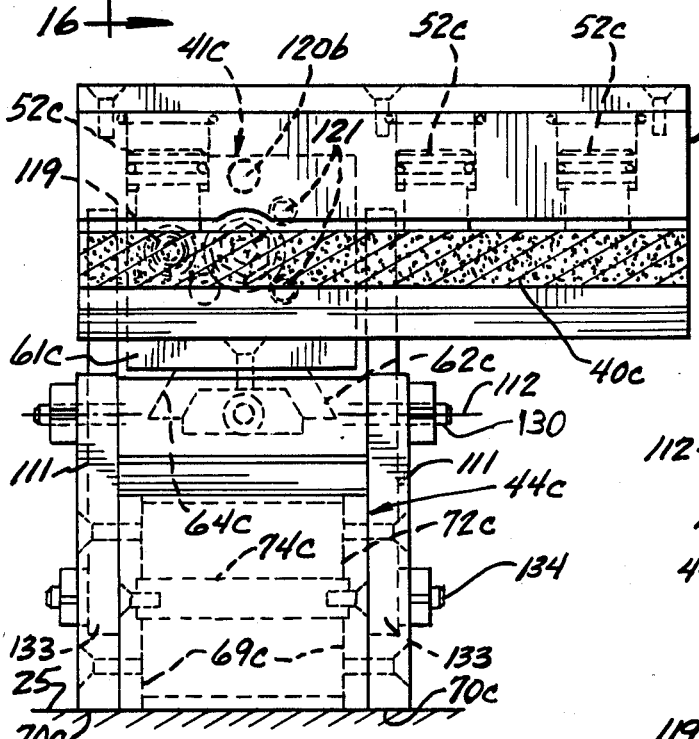
FIGS. 16 and 17 are vertical sections (the latter being fragmentary) taken along the lines 16—16 and 17—17 in FIG. 14.

The block 118 is bolted to the support plate 61c which in turn is fastened to a slide member here shown as the gib block 62c slidably mating with way surfaces 64c on a platform or way member 65c normally disposed parallel to the reference plane, as viewed in FIG. 15. For a reason to be explained shortly below, the member 65c having the the way surfaces thereon is fixed to the base 44c in a fashion such that it may be adjusted to one or more tilted positions. As it is shown in FIGS. 15, 16 and 18, the member 65c is fixed to the base in a first position wherein the axis of the lead screw 48c (and thus the predefined path) lies parallel to the reference plane. Thus, with the platform 65c adjusted as shown in FIG. 15, and with the head 115 in either of the two indexed positions, turning of the lead screw 48c feeds the carrier 41c and the stone along a predefined path which lies parallel to the reference plane.

To give the fixture 42c the versatility of acting on the cutters of a spindle which does not lie bodily above a planar work support surface, the platform or member 65c is provided with tilting adjustability. This enables the fixture 42c to accommodate spindles in the fashion described earlier relative to FIG. 9 and the specific fixture embodiment 42'.

As shown in FIGS. 13–16, the vertical posts 111 which extend upwardly from the base 44c are drilled to receive a pivot pin 130 which passes through the lower, forward portion of the lead screw support, i.e., the platform member 65c. The pivot pin 130 is locked in place by appropriate retainers. The whole lead screw assembly and the movable carriage mounted thereon thus have freedom to pivot upwardly about the axis 112 as illustrated by stop motion views in FIGS. 13. To fix the support member 65 either in the horizontal position of FIG. 15 or in one of three tilted positions, a pair of links 133 (also made of paramagnetic material) have their lower ends pivotally received on a pin 134 which extends through the core member 74 of the base. These upstanding links have four spaced holes 135*a*–135*d* through which threaded thumb screws 136 may be inserted selectively for engagement in tapped holes 138 formed in the platform member 65*c*.

Figure 13:
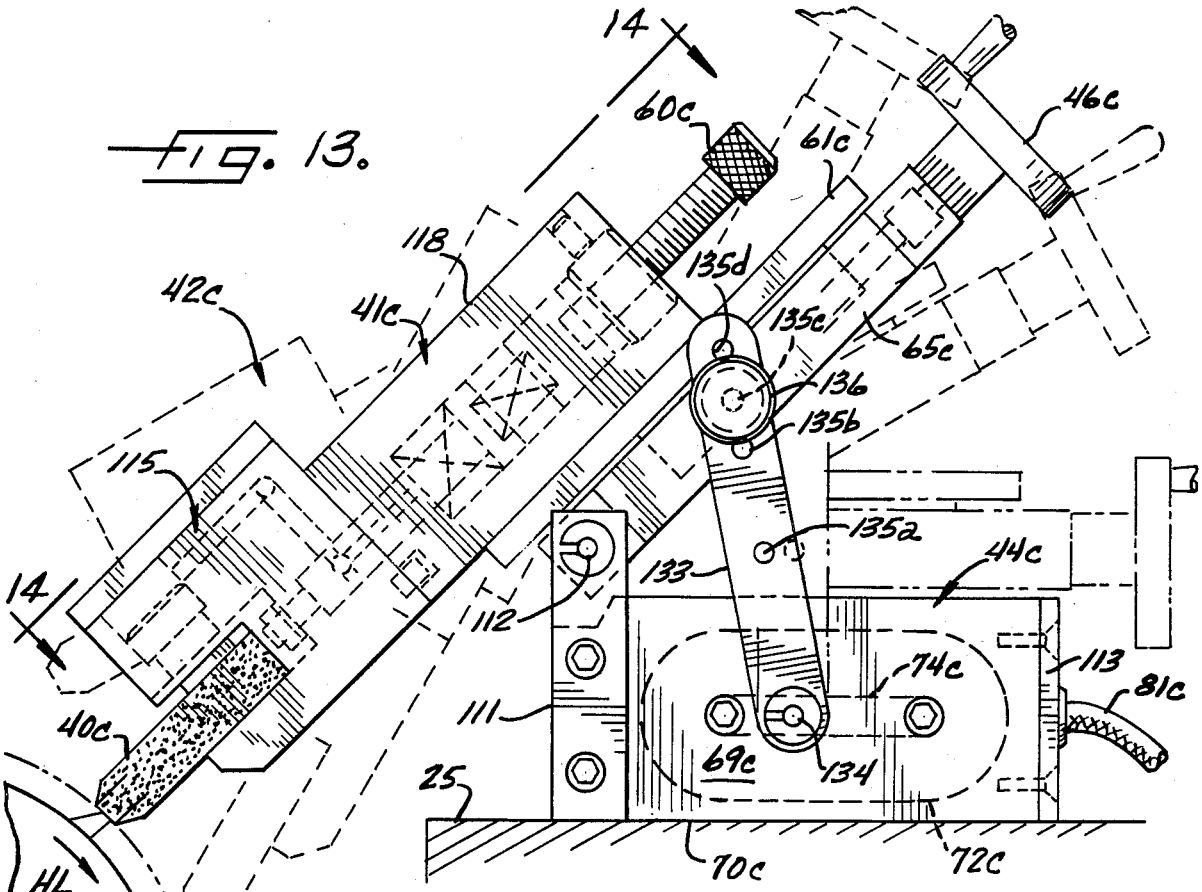
FIG. 13 is a side elevation of a further, preferred and universal embodiment of a fixture constructed in accordance with the invention and usable to practice the method of the invention.

The holes 135*a* are so located in the links 133 that when the thumb screws 136 are passed therethrough and threaded into the member 65*c*, the lead screw 48*c* and its associated way surfaces are locked in a position to make their axes lie parallel to the reference plane. This adjusted position is illustrated in FIGS. 15, 16 and 18. On the other hand, if the user of the fixture 42*c* wishes to practice the method of the invention on a spindle such as is exemplified by the spindle HL in FIG. 1, he may easily tilt the feed screw assembly upwardly about the axis 112 and lock the feed screw assembly in a selected one of several tilted positions. For this, the operator need only remove the thumb screws 136, tilt the member 65 upwardly and replace the thumb screws through one of the holes 135*b*, 135*c* or 135*d* within the links 133 such that the screws reengage and thread into the tapped holes 138 of the member 65*c*. Now the fixture is conditioned such that it can function completely in the manner described above with reference to FIG. 9 and the fixture 42'. The stone 40*c* carried in the indexable head 115 will project downwardly at an angle inclined relative to the reference plane of the fixture (and thus inclined relative to a planar work surface such as 25 on a machine tool) so as to move inwardly toward the cutters of a rotating spindle. The infeed path can be made to be essentially radial of the spindle's axis, even though that spindle is bodily located almost entirely below the planar work support surface 25. One will recognize that the fixture 42*c*, as adjusted and appearing in FIG. 13, is usable to practice the present method in the same way as the fixture 42' of FIG. 9 is used.

In summary, the fixture 42*c* here illustrated in FIGS. 13–19 permits the user to joint the cutters of rotating spindles in machine tools in circumstances which require practice of the method according to Case I or according to Case II;—and it also permits a spindle disposed mostly "under" or "behind" a work support surface to be treated as described earlier with reference to FIG. 9.

In all versions of the methods and apparatus described above, the abrasive stone (40 or 140) is preferably chosen to be of a relatively "soft" grade. Typical suitable grades are carborundum brand type C600-K5-VDC or Norton brand type 39C 600 HVK. Such stones may be roughly shaped at their operative edges to approximately conform to the contour (straight or profiled) of the cutter edges to be treated. Then, after the stone has been locked in the fixture, and the fixture locked to the machine work support surface with the stone's edge generally alined with a cutter edge, manual rotation of the spindle will result in the cutters shaping the stone precisely to the contour of, and exact alinement with the edges of, the cutter edges. The soft stone has relatively low strength when scraped by the cutters at low speed, so that it is "ground down" by the cutter edges; conversely, when the spindle is thereafter power driven at a working speed to give the cutter edges high velocity, the stone in effect has greater strength and it "grinds down" the cutter edges and suffers relatively little wear. Although "hard grade" abrasive stones may be used in the practice of the invention, the softer stones make the procedure for "jointing" cutters faster and more convenient in the sense that the stone edge shape need not be exactly determined prior to mounting of the stone in the fixture, and the alinement of the stone edge to the cutter edges need not be so exact prior to locking the fixture to the machines work support surface.

The present method and apparatus brings cutter equalization or "jointing" within the reach of any shop operator who buys economy type machine tools, or has old machine tools, not equipped with built in attachments or special mounting pads. Text experience has shown that the present method, and a fixture of the sort here described, may be used to joint four cutters in a single moulder in the span of about twenty minutes. The same fixture or fixtures may then be used to similarly joint the cutters on a whole series of machine tools even when each is of a specifically different design.

I claim:

1. A portable fixture for in situ high cutter dressing of cutter elements carried by, and circumferentially spaced around the axis of, a power-driven rotational spindle in a machine tool, the machine tool having a planar work support surface lying either parallel or normal to the spindle axis, said fixture comprising, in combination (a) a base having a planar foot surface adapted to rest on said planar work support surface, said surfaces being surfaces of magnetically permeable members, (b) means for creating an on-off controllable m.m.f. in said base to establish on-off controllable magnetic flux through said base and said foot surface, (c) an abrasive stone carrier supported by, and linearly movable along a predefined path relative to, said base (d) means for locking an abrasive stone in said carrier with an operative edge of the stone projecting therefrom, and (e) means for moving said carrier to adjusted positions along said predefined path, whereby said fixture may be placed on a machine tool work support surface and slidably shifted—when said means (b) are off—to bring the operative stone edge into juxtaposed alinement with cutter element edges, after which each means (b) may be turned on to lock said fixture on the work support surface so that infeeding of the stone may be produced by said means (e) to dress off any high cutters.

2. The combination set out in claim 1 further characterized in that said means (b) includes an electromagnetic coil disposed in said base, and on-off switch means for exciting said coil with current from a voltage source.

3. The combination set out in claim 1 further characterized in that said means (d) includes hydraulic pressure actuated jaw means for releasably locking an abrasive stone, and means for applying and relieving hydraulic pressure on said jaw means.

4. The combination set out in claim 1 further characterized by precision ways for supporting said carrier on said base, and said means (e) includes a precision lead screw for adjustably positioning the carrier along the ways.

5. The combination as set forth in claim 1 further characterized in that said stone carrier includes not only said means (d) which are oriented to hold a first stone with its operative edge disposed longitudinally in a plane lying parallel to a reference plane defined by said foot surface, but also means (d1) oriented to hold a second abrasive stone with its operative edge disposed longitudinally in a plane lying perpendicular to said reference plane, whereby said fixture may be employed for high cutter dressing of cutter elements carried by first or second spindles having their axes respectively parallel or normal to a machine tool work support surface, said first stone being active in the first case and said second stone being active in the second case.

6. The combination set forth in claim 1 further characterized in that said carrier is disposed to move along a predefined path which lies parallel to a reference plane defined by said foot surface.

7. The combination set forth in claim 1 further characterized in that said carrier is disposed to move along a predefined path which lies at a downwardly inclined angle relative to a reference plane defined by said foot surface whereby a carried stone may be infed toward the cutting elements carried by a spindle whose axis lies below a horizontal work support surface of a machine tool.

8. The combination set forth in claim 1 further characterized in that said carrier (c) is supported by and linearly movable along said predefined path relative to a subcarrier which in turn is supported by and linearly movable along a predetermined path relative to said base, said predefined and predetermined paths lying at a right angle relative to one another, one of said paths lying parallel to a reference plane defined by said foot surface.

9. The fixture defined by claim 1 further characterized in that said stone carrier (c) and locking means (d) include (c1) a slide member supported by, and linearly movable along a predefined linear path relative to, said base (c2) a jaw-carrying head supported by said slide member and having means for releasably holding an abrasive stone with its operative edge projecting therefrom, and (c3) indexable means mounting said head on said slide member to afford the setting of the edge of said stone in either of at least two orientations relative to a reference plane defined by said planar foot surface.

10. The fixture defined by claim 9 wherein said indexable means include means for selectively setting and locking said head in either (i) a first position such that the longitudinal operative edge of a locked-in stone is parallel to said reference plane, or (ii) a second position such that the longitudinal operative edge of a locked-in stone is normal to said reference plane.

11. The fixture defined by claim 9 further characterized in that said fixture includes a platform mounted on said base and supporting said slide member, said platform in a first adjusted position making said predefined linear path lie in a plane parallel to said reference plane, and means for tilting said platform relative to said base into a second adjusted position, whereby when said base is placed with its foot surface upon a horizontal work support surface, the predefined path, along which said stone carrier is movable, lies downwardly inclined in relation to the work support surface.

12. A portable fixture for in situ high cutter dressing of cutter elements carried by and circumferentially spaced around the axis of a power-driven rotational spindle in a machine tool, the elements having cutting edges disposed generally longitudinally parallel to the spindle axis, and the machine tool having a planar work support surface formed on a member made of ferromagnetic material, such support surface lying either (I) parallel to or (II) normal to the spindle axis, said fixture comprising, in combination (a) a base having a planar foot surface defining a reference plane, said foot surface being engageable with said work support surface and normally slidable relative thereto, (b) means for creating on on-off controllable m.m.f. in said base to establish or remove magnetic flux through said base and ferro-magnetic member to releasably lock the base to the work support surface.

(c) a slide member movable relative to said base along a predefined linear path which lies parallel to said reference plane, (d) means for adjusting said slide member to desired positions along said path, (e) a jaw head connected to and supported by said slide member, said jaw head having jaws means to releasably hold an abrasive stone with an operative edge disposed generally longitudinally in a plane which lies normal to said predefined path, and (f) an indexable member supporting said head and adjustable to either of two indexed positions wherein said operative edge of a stone in said jaw means lies longitudinally (I) parallel to, or (II) normal to, said reference plane, said fixture thereby being characterized by the advantage that after magnetic locking of the base to said work support surface with the edge of the stone in juxtaposed alignment with the edge of a cutter in said spindle, the edge of the stone may be infed along said predefined path to joint the cutter edges—in either of the cases where the spindle axis is (I) parallel to, or (II) normal to the work support surface—simply by the prior indexing adjustment of said indexable member respectively to make the operative edge of the jaw-carried stone longitudinally (I) parallel to, or (II) normal to said reference plane.

13. The fixture defined in claim 12 further characterized by (g) a way member interposed between said base and said slide member, with surfaces on said way member constraining the slide member for linear movement along said predefined path, and (h) adjustment means for setting said way member oriented in relation to said base such that said predefined path lies either (I) parallel to, or (II) inclined at an angle to, said reference plane, whereby upon magnetic locking of said base to said work support surface said case (I), the slide member may be moved to feed the stone inwardly toward the cutters of a spindle which is disposed either (i) bodily above said work support surface or (ii) bodily below the work support surface.

14. A portable fixture for in situ high cutter jointing of cutter elements carried by and circumferentially spaced around the axis of a power-driven rotational spindle in a machine tool, said machine tool having a magnetically permeable member defining a horizontal, planar work support surface, said machine tool having either or both of (i) a cutter-carrying spindle with its axis disposed parallel to said planar work support surface and above such surface, or (ii) a cutter-carrying spindle with its axis disposed parallel to said planar surface but below such surface, in which case the surface is interrupted by a slot through which the cutter elements move to engage a workpiece, said fixture comprising, in combination (a) a base having a planar foot surface, (b) means for magnetically locking said base to said work support surface after the base foot surface has been engaged and located on the support surface, (c) a way member, (d) a slide member and means for moving the latter to adjusted positions along a predetermined linear path relative to the way member, (e) a jaw head carried by said slide and having jaw means for releasably locking an abrasive stone with its operative edge both (1) lying longitudinally substantially parallel to said planar foot surface and (2) lying longitudinally substantially perpendicular to said linear path, and (f) means coupling and fixing said way member to said base with adjustabilty to either of two positions, namely, a first position in which said predefined path lies in a plane parallel to said planar foot surface, so that when the base is placed on the work support surface, the stone may be fed substantially radially inward toward cutters of a type (i) spindle as designated above, and a second position in which said predefined path lies inclined downwardly relative to said planar foot surface, so that when the base is placed on the work support surface, the stone may be fed in a downwardly inclined direction and substantially radially inward toward the cutters of a type (ii) spindle as designated above.

* * * * *